US011913719B2

(12) United States Patent
Kaneda

(10) Patent No.: US 11,913,719 B2
(45) Date of Patent: Feb. 27, 2024

(54) LIQUEFACTION APPARATUS

(71) Applicant: L'Air Liquide, Societe Anonyme pour l'Etude et l'Exploitation des Procedes Georges Claude, Paris (FR)

(72) Inventor: Takuya Kaneda, Hyogo (JP)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 261 days.

(21) Appl. No.: 17/155,749

(22) Filed: Jan. 22, 2021

(65) Prior Publication Data

US 2021/0222948 A1 Jul. 22, 2021

(30) Foreign Application Priority Data

Jan. 22, 2020 (JP) ..... 2020-008148

(51) Int. Cl.
*F25J 1/02* (2006.01)
*F25J 1/00* (2006.01)
*F25J 3/04* (2006.01)

(52) U.S. Cl.
CPC ..... *F25J 3/04412* (2013.01); *F25J 1/0037* (2013.01); *F25J 1/004* (2013.01);
(Continued)

(58) Field of Classification Search
CPC .... F25J 3/04412; F25J 3/04393; F25J 1/0015; F25J 2230/24; F25J 2230/42;
(Continued)

(56) References Cited

U.S. PATENT DOCUMENTS

2013/0013233 A1* 1/2013 Murakami ..... F03D 17/00
2015/0153714 A1* 6/2015 Ho ..... H02J 3/381 700/291
2017/0219265 A1* 8/2017 Barjhoux ..... F25B 49/02

FOREIGN PATENT DOCUMENTS

CN 101223260 A * 7/2008 ..... F25J 1/0025
FR 3024219 * 1/2016 ..... F25J 1/0244
(Continued)

*Primary Examiner* — Brian M King
(74) *Attorney, Agent, or Firm* — Justin K. Murray

(57) ABSTRACT

A liquefaction apparatus that automatically adjusts the load on the liquefaction apparatus correspondingly with an upper limit value of contracted power in different time slots, and which is capable of maximizing the amount of liquefied product produced and of achieving optimum operating efficiency is provided. In certain embodiments, the liquefaction apparatus can include: a production amount calculation unit 91 for obtaining an actual production amount of a liquefied product; a predicted power calculation unit 92 for obtaining a predicted power amount after a predetermined time has elapsed, on the basis of an integrated power value obtained by integrating a usage power; and a power demand control unit 93 for comparing the predicted power amount and a moving average of instantaneous power, and controlling a discharge flow rate of a compressor 3 in such a way as to come infinitely close to a target value, without exceeding the target value, and while using the larger value of the predicted power amount and the moving average of instantaneous power as a value being controlled.

2 Claims, 1 Drawing Sheet

(52) U.S. Cl.
CPC ..... *F25J 1/0221* (2013.01); *F25J 1/0224* (2013.01); *F25J 1/0234* (2013.01); *F25J 1/0252* (2013.01); *F25J 1/0254* (2013.01); *F25J 3/04393* (2013.01); *F25J 1/0015* (2013.01); *F25J 2230/24* (2013.01); *F25J 2230/42* (2013.01)

(58) Field of Classification Search
CPC ..... F25J 1/0037; F25J 1/004; F25J 1/0224; F25J 1/0234; F25J 1/0245; F25J 1/0228; F25J 1/0252; F25J 1/0254; F25J 2210/42
See application file for complete search history.

(56) References Cited

FOREIGN PATENT DOCUMENTS

| | | | | | |
|---|---|---|---|---|---|
| JP | H05-45050 | | | 2/1993 | |
| JP | 3326535 | B2 | * | 9/2002 | ..... F25J 1/0037 |
| JP | 3856538 | B2 | * | 12/2006 | |
| JP | 2022014450 | A1 | * | 1/2022 | ..... F25J 1/0037 |
| WO | WO-2011114752 | A1 | * | 9/2011 | ..... F03D 17/00 |

* cited by examiner

LIQUEFACTION APPARATUS

CROSS REFERENCE TO RELATED APPLICATIONS

This application claims the benefit of priority under 35 U.S.C. § 119 (a) and (b) to Japanese patent application No. JP2020-008148, filed Jan. 22, 2020, the entire contents of which are incorporated herein by reference.

FIELD OF THE INVENTION

The present invention relates to a liquefaction apparatus for liquefying nitrogen gas produced in an air separation apparatus.

BACKGROUND OF THE INVENTION

JP H05-45050 describes a method for liquefying gas by utilizing cold of liquid natural gas, by means of a liquefaction process comprising one or more gas compressors, one or more gas expansion turbines, and a heat exchanger for performing heat exchange between the gas and the liquid natural gas.

According to JP H05-45050, the expansion turbine is stopped or operated at reduced capacity when there is an increase in the amount of liquid natural gas supplied, and the expansion turbine is run or operated at high capacity when there is a reduction in the amount of liquid natural gas supplied.

The load on the compressor is varied when there is an increase or a reduction in the amount of liquefied product produced.

Power is needed to drive the compressor, and the amount of power used by the compressor is normally constant because the compressor operates at a fixed capacity, but a greater amount of power than normal needs to be supplied when it is wished to increase the amount of liquefied product produced.

However, commercial power is set in advance by contract with a power company or the like, and heavy penalties are applicable if the contract is not observed.

That is to say, it is absolutely essential to prevent any excess power consumption beyond the power contract.

However, the amount of liquefied product produced is not maximized because of fixed operation where the maximum operating point is maintained at a level where there is a margin, in order to prevent excess power consumption beyond the power contract.

Additionally, the pressure and temperature balance within the system are disrupted as the external air temperature and cooling water temperature, etc. change, so it is also difficult to achieve optimum operating efficiency.

SUMMARY OF THE INVENTION

The objective of certain embodiments of the present invention therefore lies in providing a liquefaction apparatus that automatically adjusts the load on the liquefaction apparatus correspondingly with an upper limit value of contracted power in different time slots, and which is capable of maximizing the amount of liquefied product produced and of achieving optimum operating efficiency.

A further objective of the present invention lies in providing an air separation apparatus comprising the liquefaction apparatus.

A liquefaction apparatus according to an embodiment of the present invention can include: a predicted power calculation unit configured to obtain a predicted power amount after a predetermined time (e.g., 10-40 minutes) has elapsed, on the basis of an integrated power value obtained by integrating a usage power; and a power demand control unit for comparing the predicted power amount and a moving average (e.g., 1 minute) of instantaneous power, and controlling a (variable) discharge flow rate of a compressor in such a way as to come infinitely close to a target value, without exceeding the target value, and while using the larger value of the predicted power amount and the moving average of instantaneous power as a value being controlled.

When the "target value" is used up to an upper limit value of contracted power in each time slot, this constitutes a maximum power amount under contract.

A load on the liquefaction apparatus can be automatically adjusted to improve efficiency.

The production amount of the liquefaction apparatus as a whole can be increased or reduced by making the discharge flow rate of the compressor variable.

The abovementioned liquefaction apparatus may include: a compressor for compressing a product gas; a heat exchanger for cooling the compressed product gas; an expansion turbine for expanding the compressed product gas drawn out from an intermediate portion of the heat exchanger; an expansion valve for expanding the cooled (or liquefied) compressed product gas drawn out from the heat exchanger; a gas-liquid separator for separating the liquefied product gas expanded by the expansion valve into gas and liquid; and a production amount calculation unit for obtaining an actual production amount of liquefied product.

The abovementioned liquefaction apparatus may comprise an expansion turbine inlet nozzle for controlling an inlet pressure of the expansion turbine to a constant level and for maintaining an expansion ratio at a maximum value.

The abovementioned liquefaction apparatus may comprise: a temperature sensor for measuring an inlet and an outlet temperature of the expansion valve; and a temperature control unit for controlling a temperature difference of an inlet and an outlet of the expansion valve, as measured by the temperature sensor.

As a result, it is possible to minimize flash loss even if there is a variation in a processing amount of the expansion turbine.

Secondary-side flash loss of the expansion valve increases when a flow rate balance to the expansion turbine and the expansion valve is disrupted, but this can be prevented by performing control in such a way that the temperature difference between the inlet and the outlet of the expansion valve is reduced or kept within a predetermined range.

By virtue of the abovementioned configuration, the load on an air-liquid separation apparatus which is a supply source of starting-material nitrogen gas or the like is also adjusted in conjunction with load adjustment of the liquefaction apparatus as a whole, and as a result a starting material discharge loss is completely controlled to zero.

Furthermore, the overall load adjustment of the air-separation apparatus employs high-level control in accordance with a load target of the liquefaction apparatus determined by control of the power demand control unit, the load adjustment is automatically performed without any manual intervention at all, and the product purity and generation amount are suitably controlled.

Furthermore, when the amount of liquefied product is intentionally reduced, control is performed to automatically reduce the production amount to any production amount by freely setting the "target value" in the control afforded by the power demand control unit.

BRIEF DESCRIPTION OF THE DRAWINGS

Further developments, advantages and possible applications of the invention can also be taken from the following description of the drawing and the exemplary embodiments. All features described and/or illustrated form the subject-matter of the invention per se or in any combination, independent of their inclusion in the claims or their back-references.

DETAILED DESCRIPTION OF THE INVENTION

Several modes of embodiment of the present invention will be described below. The modes of embodiment described below are given as an example of the present invention.

The present invention is in no way limited by the following modes of embodiment, and also includes a number of variant modes which are implemented within a scope that does not alter the essential point of the present invention.

It should be noted that the constituent elements described below are not all necessarily essential to the present invention.

Figure 1:
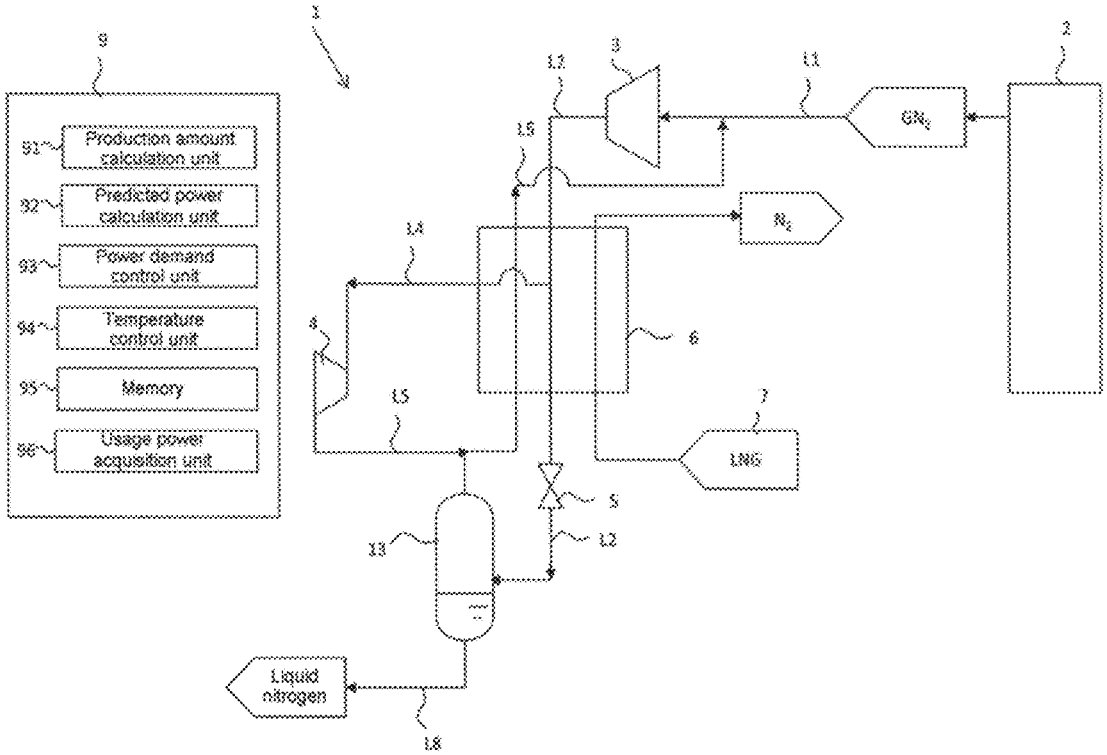
FIG. 1 is a diagram showing a liquefaction apparatus and an air separation apparatus according to Mode of Embodiment 1.

A liquefaction apparatus 1 and an air separation apparatus 2 according to Mode of Embodiment 1 will be described with the aid of FIG. 1.

The liquefaction apparatus 1 comprises: a nitrogen gas introduction pipe L1 running from the air separation apparatus 2; a compressor 3 for compressing the nitrogen gas; a heat exchanger 6 for cooling and liquefying compressed nitrogen gas compressed by the compressor 3 by using cold of an LNG cold source 7; a pipe L4 which branches and leads out a portion of the compressed nitrogen gas cooled to an intermediate temperature by the heat exchanger 6; an expansion turbine 4 which is provided in the pipe L4 and generates cold by expanding the compressed nitrogen gas; a pipe L5 which introduces the nitrogen gas expanded by the expansion turbine 4 into the heat exchanger 6 as a nitrogen gas cold source, and causes said nitrogen gas to merge on an intake side of the compressor 3 after the temperature thereof has been raised; a gas-liquid separator 13; a drawing line L8 for drawing out a liquefied product extracted from the gas-liquid separator 13; and a distributed control device 9.

The expansion turbine 4 supplies cold. Specifically, operation of the expansion turbine 4 is as follows.

Compressed nitrogen gas which has been compressed to a high pressure passes through a turbine casing and is subjected to adiabatic expansion up to an intermediate pressure in an expansion turbine inlet nozzle (not depicted), and then enters a turbine rotor as high-speed gas.

The nitrogen gas performs expansion work in the turbine rotor while undergoing further adiabatic expansion up to an outlet pressure, and the temperature of the nitrogen gas decreases.

The gas which has thus been reduced in temperature in comparison with turbine inlet gas exits the turbine and is fed to the heat exchanger 6 where cold is supplied thereto.

Motive power generated by the turbine rotor is transmitted to a brake fan directly linked to another end of a main shaft, and the temperature and pressure of a brake gas are raised, whereby motive power obtained by the turbine is extracted to outside the system.

In this mode of embodiment, the expansion turbine inlet nozzle controls the inlet pressure of the expansion turbine 4 to a constant level and maintains the expansion ratio at a maximum value.

The compressed nitrogen gas which has been compressed to a high pressure by the compressor 3 is fed to the heat exchanger 6 through the pipe L2.

The compressed nitrogen gas which has been cooled by the heat exchanger 6 is expanded by the expansion valve 5, after which it is introduced into the gas-liquid separator 13.

Liquid nitrogen inside the gas-liquid separator 13 is drawn out from the pipe L8 and fed to a liquid nitrogen storage tank (not depicted), or the like.

The nitrogen gas inside the gas-liquid separator 13 merges in the pipe L5 and is introduced into the heat exchanger 6, forming a portion of a cooling source for the compressed nitrogen gas, and after the temperature thereof has been raised, said nitrogen gas merges in the nitrogen gas introduction pipe L1 on the intake side of the compressor 3.

A temperature sensor for measuring an inlet and an outlet temperature of the expansion valve 5 is furthermore provided.

The distributed control device 9 comprises: a production amount calculation unit 91; a predicted power calculation unit 92; a power demand control unit 93; a temperature control unit 94; a memory 95 for storing various types of data; and an acquisition unit 96 for acquiring, from a power meter, a usage power (instantaneous power) used by the compressor 3 in real time.

The production amount calculation unit 91 obtains an actual production amount of liquid nitrogen.

The predicted power calculation unit 92 obtains a predicted power amount used by the compressor 3 after a predetermined time has elapsed, on the basis of an integrated power value obtained by integrating the usage power.

The integrated power value is the total usage power amount within a set predetermined time (e.g., within a set time of between 20 minutes and 60 minutes immediately before calculation, etc.).

The integrated power value=Σ usage power value (a cumulative value within a predetermined time).

In this mode of embodiment, the predicted power calculation unit 92 calculates, in real time, the predicted power amount after 30 minutes have elapsed.

The method for calculating the predicted power amount (kW/h) may involve obtaining a mean value by dividing the abovementioned integrated power value by the predetermined time and using this as the predicted power amount, or obtaining an amount of change (tendency) of the integrated power value per unit time, and calculating the predicted power amount correspondingly with this amount of change.

The power demand control unit 93 compares the predicted power amount with a moving average (e.g., 1 minute) of instantaneous power used by the compressor 3, and variably controls a discharge flow rate of the compressor 3 in such a way as to come infinitely close to a target value, without exceeding the target value, and while using the larger value of the predicted power amount and the moving average of instantaneous power as a value being controlled.

The temperature control unit 94 controls a temperature difference of the inlet and the outlet of the expansion valve 5.

The distributed control device 9 and the constituent components thereof may comprise at least: one or more processors, and a memory for storing a program defining a processing procedure, and may be configured by an on-premises server device, a cloud server device, dedicated circuitry, or firmware, etc.

Figure 2:
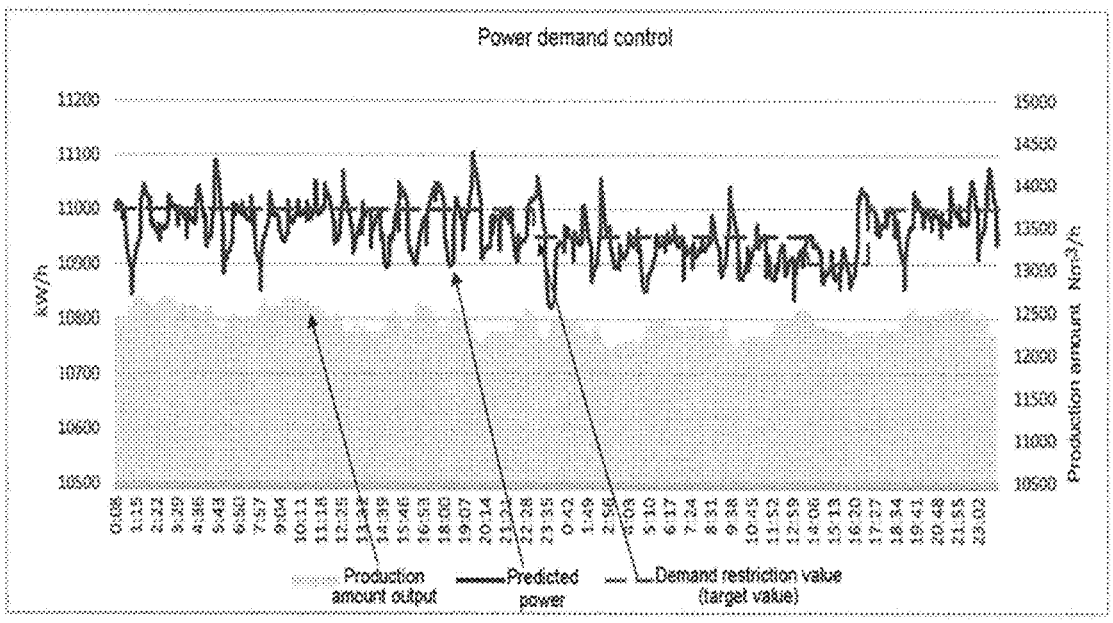
FIG. 2 is a diagram showing an example of power demand control in Mode of Embodiment 1.

FIG. 2 is a two-axis graph where the right-hand vertical axis shows a production amount, the left hand vertical axis shows a power amount, and the horizontal axis shows time.

The predicted power value is depicted by a solid bent line, a demand control value (target value) is depicted by a broken line, and the production amount therebelow is depicted by an area line.

According to this mode of embodiment, it was possible to maximize usage of contracted power and the production amount of liquid nitrogen could be increased by between 3 and 5% in comparison with the prior art, with liquefaction efficiency also being improved by 2%.

Furthermore, an alarm was no longer generated when the contracted power was approached, it was also possible to reduce the number of times that operation of the liquefaction apparatus 1 was changed, and this also contributed to automating operation of the air separation apparatus 2 and the liquefaction apparatus 1.

(1) Although not especially depicted, control valves, pressure regulating devices and flow rate control devices, etc. may be installed in the pipes in order to regulate valve opening/closing, regulate pressure, or regulate flow rate.

(2) The expansion turbine 4 may be either an axial flow turbine or a radial turbine.

The liquefaction apparatus 1 is not limited to a configuration comprising a single expansion turbine, and a plurality of expansion turbines may be arranged in series or in parallel.

(3) The compressor 3 may be constructed as a single element, or a plurality of compressors may be arranged in series in multiple stages to construct a compressor unit.

(4) The liquefaction apparatus 1 is not limited to a configuration comprising a single heat exchanger 6, and a plurality of heat exchangers may be arranged in parallel, and a piping course to a warm end and a cold end and an intermediate end of the heat exchanger may be constructed in conjunction with the multi-stage configuration of the compressor unit.

(5) The heat exchanger 6 uses cold of the LNG cold source 7, but this is not limiting, and it may equally use cold supplied from a refrigerator, or may use cold from a plurality of expansion turbines.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

LIST OF REFERENCE NUMERALS

1 . . . Liquefaction apparatus
2 . . . Air separation apparatus
3 . . . Compressor
4 . . . Expansion turbine
5 . . . Expansion valve
6 . . . Heat exchanger
9 . . . Distributed control device
13 . . . Gas-liquid separator

What is claimed is:

1. A liquefaction apparatus for liquefying a product gas, said liquefaction apparatus comprising:

a compressor configured to compress the product gas, said compressor having a variable discharge flow rate;

a heat exchanger configured to cool and liquefy the product gas exiting the compressor to form a liquid product;

a distributed control device comprising:

one or more processors; and memory coupled to the one or more processors, the memory storing instructions that, when executed by the one or more processors, cause the one or more processors collectively to perform operations comprising:

obtaining a predicted amount of power used by the compressor after a predetermined time has elapsed, on the basis of an integrated power value obtained by integrating a usage power of the compressor;

comparing the predicted amount of power used by the compressor and a moving average of an amount of power used by the compressor, and controlling the discharge flow rate of the compressor in such a way as to reduce the difference of the moving average of the amount of power used by the compressor and a target value of power used by the compressor, without exceeding the target value, and while using the larger value of the predicted amount of power and the moving average of the amount of power used by the compressor as a value being controlled, and wherein the liquefaction apparatus comprises:

an expansion valve; and wherein the one or more processors are further configured to collectively to perform an operation of controlling a temperature difference of an inlet and an outlet of the expansion valve.

2. An air separation apparatus comprising a liquefaction apparatus according to claim 1.

* * * * *